US011067234B2

(12) United States Patent
Bonnetto et al.

(10) Patent No.: US 11,067,234 B2
(45) Date of Patent: Jul. 20, 2021

(54) LIGHTING DEVICE

(71) Applicant: SIGNIFY HOLDING B.V., Eindhoven (NL)

(72) Inventors: Julie Bonnetto, Eindhoven (NL); Thomas Deflandre, Eindhoven (NL); Joachim Paul Jusselme, Eindhoven (NL); Rémi Noirot, Eindhoven (NL); Nicolas Mignot, Eindhoven (NL); Theo Renaudin, Eindhoven (NL)

(73) Assignee: Signify Holding B.V., Eindhoven (NL)

( * ) Notice: Subject to any disclaimer, the term of this patent is extended or adjusted under 35 U.S.C. 154(b) by 107 days.

(21) Appl. No.: 16/069,393

(22) PCT Filed: Jan. 13, 2017

(86) PCT No.: PCT/EP2017/050707
§ 371 (c)(1),
(2) Date: Jul. 11, 2018

(87) PCT Pub. No.: WO2017/125325
PCT Pub. Date: Jul. 27, 2017

(65) Prior Publication Data

US 2019/0032874 A1 Jan. 31, 2019

(30) Foreign Application Priority Data

Jan. 21, 2016 (EP) ..... 16305054

(51) Int. Cl.
*F21S 8/04* (2006.01)
*F21S 8/02* (2006.01)
(Continued)

(52) U.S. Cl.
CPC ..... *F21S 8/04* (2013.01); *F21S 8/026* (2013.01); *F21V 5/043* (2013.01); *F21V 5/046* (2013.01);
(Continued)

(58) Field of Classification Search
CPC .. F21Y 2107/30; F21Y 2103/33; F21S 8/026; F21S 8/04; F21V 5/043; F21V 5/046; F21V 29/773
See application file for complete search history.

(56) References Cited

U.S. PATENT DOCUMENTS 6,948,830 B1 * 9/2005 Petrick ..... F21V 5/045 362/229
8,419,214 B2 8/2013 Rizkin et al.
(Continued)

FOREIGN PATENT DOCUMENTS

CN 203052527 U 7/2013
CN 104930367 A 9/2015
(Continued)

*Primary Examiner* — Evan P Dzierzynski
(74) *Attorney, Agent, or Firm* — Daniel J. Piotrowski

(57) ABSTRACT

A lighting device comprises a carrier having a radially outwardly facing mounting surface and an inner cavity radially within the outer mounting surface. Solid state lighting devices are mounted on the outer mounting surface and a driver is housed in the inner cavity. A ring shaped optical unit defines a light output region of the lighting device and is mounted around the carrier. An outer housing reflects light from the arrangement of solid state lighting devices to the ring shaped optical unit. This provides a compact arrangement, in which the driver, the heat sink (implemented by the carrier), and the solid state lighting arrangement are essentially in a plane. This is possible by providing a ring of light sources facing radially outwardly, with the driver mounted radially inside the ring. The radial light output is converted to a light output with a desired direction and beam shape by the optical unit.

12 Claims, 5 Drawing Sheets

(51) Int. Cl.

| | |
|---|---|
| ***F21V 13/04*** | (2006.01) |
| ***F21V 5/04*** | (2006.01) |
| ***F21V 7/00*** | (2006.01) |
| ***F21V 29/77*** | (2015.01) |
| ***F21V 23/00*** | (2015.01) |
| *F21Y 115/10* | (2016.01) |
| *F21Y 107/30* | (2016.01) |
| *F21Y 107/10* | (2016.01) |

(52) U.S. Cl.

CPC ..... *F21V 7/0058* (2013.01); *F21V 13/04* (2013.01); *F21V 23/009* (2013.01); *F21V 29/773* (2015.01); *F21Y 2107/10* (2016.08); *F21Y 2107/30* (2016.08); *F21Y 2115/10* (2016.08)

(56) References Cited

U.S. PATENT DOCUMENTS 8,926,152 B2 1/2015 Burges
8,992,049 B2 * 3/2015 McDade ..... F21V 23/00 362/276
2007/0001613 A1 * 1/2007 Hulse ..... G02B 19/0071 313/634
2013/0021823 A1 * 1/2013 Yamagami ..... F21S 8/06 362/613
2013/0107536 A1 * 5/2013 Hiraoka ..... F21S 4/28 362/277
2013/0265778 A1 * 10/2013 Rizkin ..... F21V 13/04 362/327
2014/0268802 A1 9/2014 Sun et al.
2015/0252970 A1 * 9/2015 Athalye ..... F21V 7/0066 362/147
2016/0018097 A1 * 1/2016 Alexiou ..... F21V 29/75 362/249.02
2016/0025315 A1 * 1/2016 Igaki ..... H05B 45/00 362/382
2017/0116864 A1 * 4/2017 Zarnowski ..... G08B 5/36

FOREIGN PATENT DOCUMENTS

| | | | |
|---|---|---|---|
| EP | 2439445 | A2 | 4/2012 |
| JP | 2004296245 | A | 10/2004 |
| JP | 2009009926 | A | 1/2009 |
| JP | 2013033718 | A | 2/2013 |
| JP | 2013093196 | A | 5/2013 |
| KR | 20110058943 | A | 6/2011 |
| WO | 2011065705 | A2 | 6/2011 |
| WO | WO2011158160 | A1 | 12/2011 |

* cited by examiner

LIGHTING DEVICE

CROSS-REFERENCE TO PRIOR APPLICATIONS

This application is the U.S. National Phase application under 35 U.S.C. § 371 of International Application No. PCT/EP2017/050707, filed on Jan. 13, 2017, which claims the benefit of European Patent Application No. 16305054.5, filed on Jan. 21, 2016. These applications are hereby incorporated by reference herein.

FIELD OF THE INVENTION

The present invention relates to a lighting device which makes use of a solid state lighting element, such as a downlight.

BACKGROUND OF THE INVENTION

There is a clear trend towards the replacement of traditional, relatively energy-inefficient, light bulbs such as incandescent or fluorescent light bulbs with more energy efficient replacements. Indeed, in many jurisdictions the production and retailing of incandescent light bulbs has been outlawed, thus forcing consumers to buy energy-efficient alternatives, for example when replacing incandescent light bulbs.

A particularly promising alternative is provided by solid state lighting (SSL) elements, which can produce a unit luminous output at a fraction of the energy cost of incandescent or fluorescent light bulbs. An example of such a SSL element is a light emitting diode (LED). Lighting devices including such SSL elements now routinely find application in a wide variety of application domains, ranging from domestic applications to automotive applications for instance.

The use of solid state lighting in downlights is increasingly common. A downlight may be surface mounted or recessed, typically at a ceiling of an indoor space.

FIG. 1 schematically depicts a prior art downlight device 1 for mounting in a ceiling or another surface. The lighting device 1 comprises a housing 2 in which a carrier 4 comprises a plurality of solid state lighting elements 5 arranged to direct their respective luminous outputs through a light exit portion 6 of the housing 2. The carrier 4 may be thermally coupled to the housing 2 via a thermal interface 3, such that the thermal interface 3 and the housing 2 may act as the heat sink of the solid state lighting elements 5. Such a lighting device 1 has good efficiency due to the fact that the SSL elements 5 are arranged to produce the luminous output directly towards the light exit portion 6, but this has the disadvantage that the appearance of the lighting device 1 in operation may lack uniformity due to the fact that individual SSL elements 5 can be individually observed through the light exit portion 6, which may be undesirable. The uniformity may be improved by increasing the density of SSL elements 5, but this may negatively affect operating parameters related to the temperature management of the lighting device 1.

In order to address this problem, a prior art lighting device 1 as schematically depicted in FIG. 2 may be provided in which the carrier 4 is perpendicularly orientated relative to the light exit portion 6 on a side wall of the housing 2, which again includes the thermal interface member 3, e.g. a heat sink. Such an arrangement has the advantage that non-uniformity of the luminous output of the SSL elements 5 is less of an issue due to the fact that the bulk of the luminous output of the SSL elements 5 is not directed towards the light exit portion 6 but instead is reflected towards the light exit portion 6, e.g. by a reflective inner surface of the housing 2. This significantly mixes the luminous output of the various SSL elements 5, thereby giving the lighting device 1 a uniform appearance. However, such an indirect illumination of the light exit portion 6 is less efficient than the direct illumination principle applied by the lighting device in FIG. 1, such that in order to achieve the desired luminous flux, a higher density of SSL elements 5 may be required, which reintroduces thermal management issues as previously explained. Such conflicting design requirements are not limited to downlights.

Downlights are typically recessed into a surface. As a result, the overall height of the unit determines how easily the downlight may be installed. For a surface mount design, a smaller overall height of the unit typically gives a better aesthetic appearance.

In some designs, the solid state lighting element is part of a luminaire, and the required driver is separate from the luminaire. For recessed applications, this is not a problem because the driver can be positioned discretely in the ceiling cavity. For surface mounted applications, the driver needs to be directly assembled with the luminaire itself. The need to integrate the driver into the luminaire itself typically has implications on the control of the light output distribution and on the height of the luminaire.

To address the problem of controlling the light distribution, it is known to make use of a mixing chamber. However, this increases the number of components and the complexity of the design.

Existing recessed downlight modules for example have a height of around 100 mm to 180 mm, whereas surface mount designs should ideally be thinner.

The main remaining problem of surface mounted luminaires is the lack of space to integrate the driver and the heat sink. In some known designs, the driver is directly integrated with the downlight, but the unit still needs to be partially recessed into a hole so that only the the optical part is visible. This design cannot be used on a ceiling made of concrete for example.

There is therefore still a need for a design of lighting device which is compact to give a small height, which incorporates a driver so that it can be surface mounted, and has a simple and therefore low cost design.

SUMMARY OF THE INVENTION

The invention is defined by the claims.

Examples in accordance with an aspect of the invention provide a lighting device having an axis corresponding to a general direction in which the lighting device faces, comprising:

a carrier having an outer mounting surface extending around the axis and facing radially outwardly, and an inner cavity radially within the outer mounting surface;

an arrangement of solid state lighting devices mounted on the outer mounting surface;

a driver mounted in the inner cavity;

a ring shaped optical unit which defines a light output region of the lighting device, mounted around the carrier; and an outer housing having a reflecting inner surface for reflecting light from the arrangement of solid state lighting devices to the ring shaped optical unit, wherein the ring shaped unit has a cross sectional shape substantially according to a circle, so that the optical unit comprises a toric lens.

This provides a compact arrangement, in which the driver, the heat sink (implemented by the carrier), and the solid state lighting arrangement are essentially in a plane. This is possible by providing a ring of light sources facing radially outwardly, with the driver mounted radially inside the ring. The radial light output is converted to a light output in a desired direction by the optical unit which receives light from the lighting devices and provides the light to an output part of the optical unit.

The arrangement of solid state lighting devices may comprise one or more arrays of LEDs mounted on one more flexible carriers. For example, a lighting unit may be a ring of LEDs on a tape for mounting around the outer mounting surface, and there may be one or more such units.

The optical unit may comprise a ring having a constant cross sectional shape in a plane perpendicular to the ring direction. The ring thus has the same optical function at different angular positions, so that the overall light output distribution is rotationally symmetric. However, the ring may instead be designed to provide an optical output which varies with angle around the general light output direction. Thus, the design of the optical unit may be used to tune the light output distribution.

The ring may be a circle, so that a circular light output distribution pattern is obtained. The cross sectional shape is substantially according to a circle, so that the optical unit comprises a toric lens. Substantially according to a circle in this respect means that the cross sectional shape is according to a solid circle which may comprise a relatively small indent or protrusion which provides a seating facility to the optical unit. Such a spherical surface of a toric lens makes light to converge at a point/circular line and provides the advantage of a highly appreciated, desired effect of an exploding light pattern from said point/circular line.

The carrier for example comprises heat dissipation fins which extend radially inwardly from the back of the outer mounting surface. The carrier thus implements a heat sink function.

The device may further comprise a reflector ring mounted between the arrangement of solid state lighting devices and the optical unit. This is used to prevent light entering the optical unit from undesired angles. The reflector ring functions as a lower reflector beneath the lighting arrangement (i.e. nearer the output) and the outer housing functions as an upper reflector above the lighting arrangement (i.e. further from the output) and also radially around the outside of the lighting arrangement.

The lighting device may have a height less than 50 mm, for example less than 40 mm or even less than 35 mm.

The lighting device may comprise a downlight for surface mounting on a surface or a downlight for recess mounting into a surface. However, the design may be used as other types of compact lighting unit, and is not limited to downlights.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
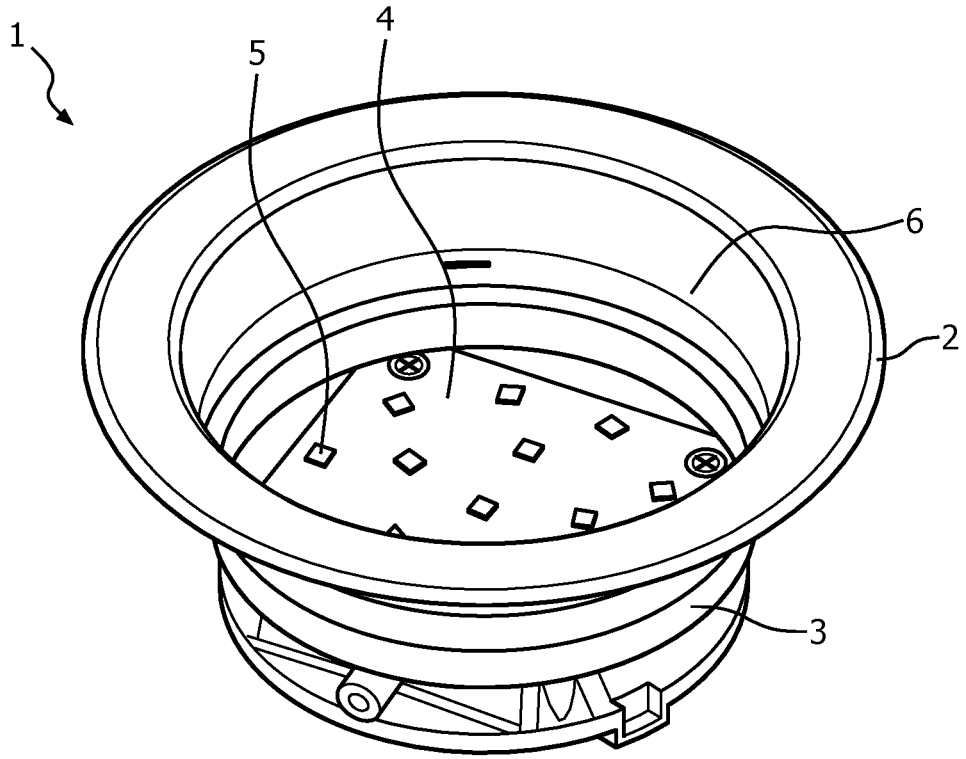
FIG. 1 (Prior art)
FIG. 1 schematically depicts a prior art downlight device.
Figure 2:
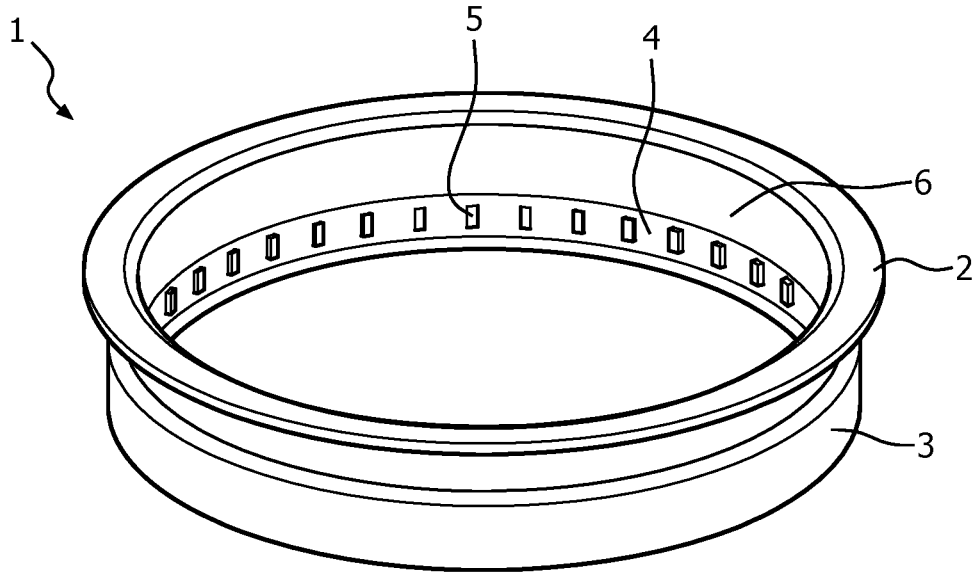
FIG. 2 (Prior art)
FIG. 2 schematically depicts another prior art downlight device.

It should be understood that the Figures are merely schematic and are not drawn to scale. It should also be understood that the same reference numerals are used throughout the Figures to indicate the same or similar parts.

The invention provides a lighting device which comprises a carrier having a radially outwardly facing mounting surface and an inner cavity radially within the outer mounting surface. Solid state lighting devices are mounted on the outer mounting surface and a driver is housed in the inner cavity. A ring shaped optical unit defines a light output region of the lighting device and is mounted around the carrier. An outer housing reflects light from the arrangement of solid state lighting devices to the ring shaped optical unit.

This provides a compact arrangement, in which the driver, the heat sink (implemented by the carrier), and the solid state lighting arrangement are essentially in a plane. This is possible by providing a ring of light sources facing radially outwardly, with the driver mounted radially inside the ring. The radial light output is converted to a light output with a desired direction and beam shape by the optical unit.

Figure 3:
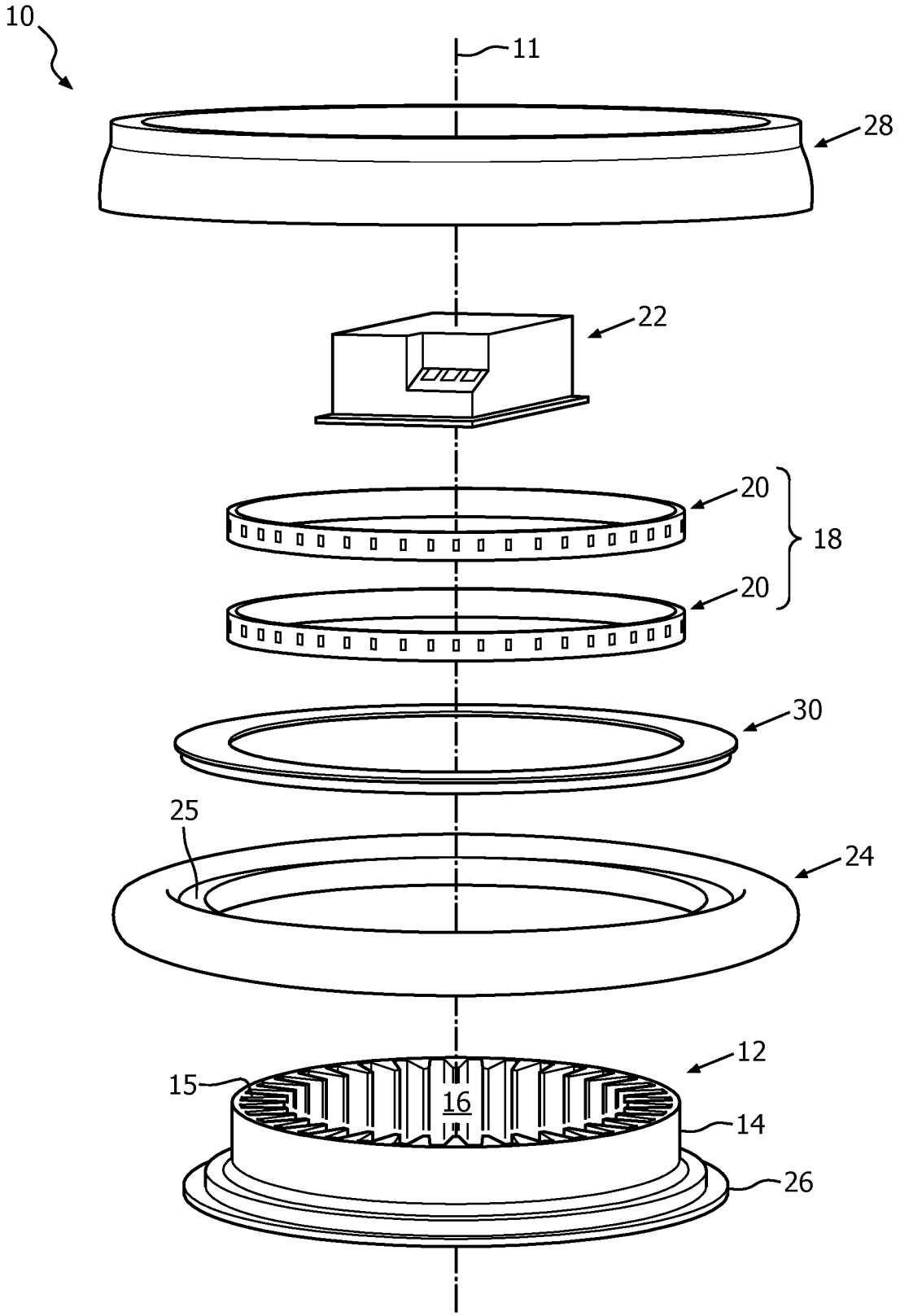
FIG. 3 schematically depicts an exploded view of a lighting device according to an embodiment.

FIG. 3 schematically depicts an exploded view of a lighting device 10 according to an embodiment. The device has an axis 11, which corresponds to the general direction in which light is output from the the device. The light output is generally centered around this axis 11, and it is the direction in which the device faces. The axis extends perpendicularly to a surface on which the lighting device is to be mounted or in which the lighting device is to be recessed.

The device comprises a carrier 12 having an outer mounting surface 14 extending around the axis 11 and facing radially outwardly. The outer surface is smooth, whereas the back of the outer mounting surface has a set of heat dissipation fins 15 so that the carrier 12 functions as a heat sink as well as a support for the LEDs. An inner cavity 16 is defined radially within the outer mounting surface, i.e. behind the outer mounting surface.

An arrangement 18 of solid state lighting devices 20 such as LEDs is mounted on the outer mounting surface 14, not shown in FIG. 3 as a result of the exploded view. The arrangement of solid state lighting devices is shown as two rings of LEDs each ring mounted a flexible carrier. Each ring of LEDs is mounted around the outer mounting surface. There may be one ring, or more than two rings.

A driver 22 is mounted in the inner cavity 16, again not shown in FIG. 3 as a result of the exploded view.

A ring shaped optical unit 24 defines a light output region of the lighting device. It is mounted around the carrier 12. In the example shown, the optical unit 24 has an inner lip 25 which provides seating of the optical unit 24 against a rim 26 of the carrier 12. The optical unit is made of a transparent material such as a plastic (e.g. PMMA or PC) or glass, with a refractive index greater than 1 (typically in the range 1.4 to 1.6) to provide a refractive index difference to the surrounding air, and thereby provide a lens function.

An outer housing 28 has a reflecting inner surface for reflecting light from the arrangement 18 of solid state lighting devices to the ring shaped optical unit 24. The radial outer surface of the outer housing 28 reflects radially directed light downwardly towards the optical unit 24, and for this purpose, the radial outer surface has a taper as shown. Light emitted upwardly from the LEDs is reflected by a top wall of the outer housing 28.

Positioned below the ring or rings of LEDs is an inner reflector ring 30. This ensures that downwardly directed light only enters a desired region of the optical unit 24. The reflecting surfaces provide light recycling until the light impinges on the desired part of the optical unit 24 to then be transmitted to the output.

This provides a compact arrangement, in which the driver 22, the heat sink (implemented by the carrier 12), and the solid state lighting arrangement 18 are essentially in a plane. This is possible by providing a ring of light sources facing radially outwardly, with the driver mounted radially inside the ring.

The design has few components, for example with only one transmitting optic for an array of LEDs, one top reflector which is implemented by the housing and one inner reflector, which may in some designs be avoided.

Figure 4:
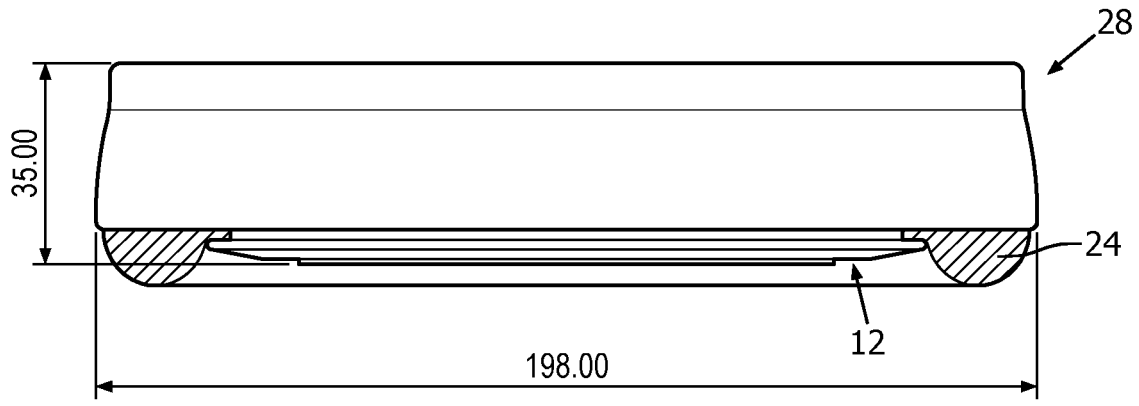
FIG. 4 shows an example set of dimensions for the device of FIG. 3.

To keep the overall height as low as possible, a low height off-the-shelf driver may be chosen. By way of example, FIG. 4 shows an implementation designed for an existing low height driver, in which the overall height is kept to 35 mm, with an overall diameter of 198 mm. As a result of the low height, the design can be installed in applications that require discrete luminaires. The lighting device may more generally have a height less than 50 mm, for example less than 40 mm. The same principle could be applied with a customized driver PCB which could be directly fixed onto the outer housing 28, allowing an even lower overall height of the luminaire, for example less than 30 mm.

FIG. 4 shows that the bottom part of the optical unit 24 defines the optical output surface of the lighting device. The light output is in the form of an annulus.

An advantage of the design is that it can either be surface mounted or recessed. For surface mounted applications, there is no need to drill a hole in the ceiling to fit the luminaire. The unit can simply be screwed to the ceiling (or wall). It can be designed to also fit into an existing standard size (200 mm) recess hole.

The design thus provides simplicity, with a small size in particular low height, but with the driver directly integrated into the device.

The particular example of a toric lens results in an aesthetic circular downlight output and is used to tune or collimate the light into a desired light distribution. In the embodiment of FIG. 4 the lens is partly recessed inside the housing 28, however, generally spoken, the lens may take any position in between fully recessed and fully outside the housing (viewed in a direction alongside the axis) for essentially all types of embodiments of the lighting device according to the invention. Variation in this position can be used to vary/control the desired collimation/beam shaping of light by the lens and thus the desired light distribution to be issued by the lighting device. Preferably, an optical gap between the lower end of the housing and the lens is obviated to avoid or minimize direct view of (individual) LEDs or leakage of non-tuned light (for example non-collimated light) through said gap.

A torus is the spatial body resulting when a circle with radius r rotates around an axis lying within the same plane as the circle, at a distance R from the circle's center. If R>r as in this example, a ring torus is produced.

The use of a toric lens is not essential. Different designs of the optical unit may be used to produce desired beam shaping for all kinds of applications, including outdoor lighting.

More generally, the optical unit may comprise any suitable design of ring shaped lens device. In one set of examples, the ring has a constant cross sectional shape in a plane perpendicular to the local ring direction, i.e. the local tangential direction around the ring shape. The ring thus has the same optical function at different angular positions, so that the overall light output distribution is rotationally symmetric. However, the ring may instead be designed to provide an optical output which varies with angle around the light output direction.

In the case of a circular device, the ring is a circle, so that a circular light output distribution pattern is obtained. When the cross sectional shape is also a circle, the optical unit comprises a toric lens. However, the ring may be oval or even polygonal, since different aesthetic appearances will be desired for different applications.

Figure 5:
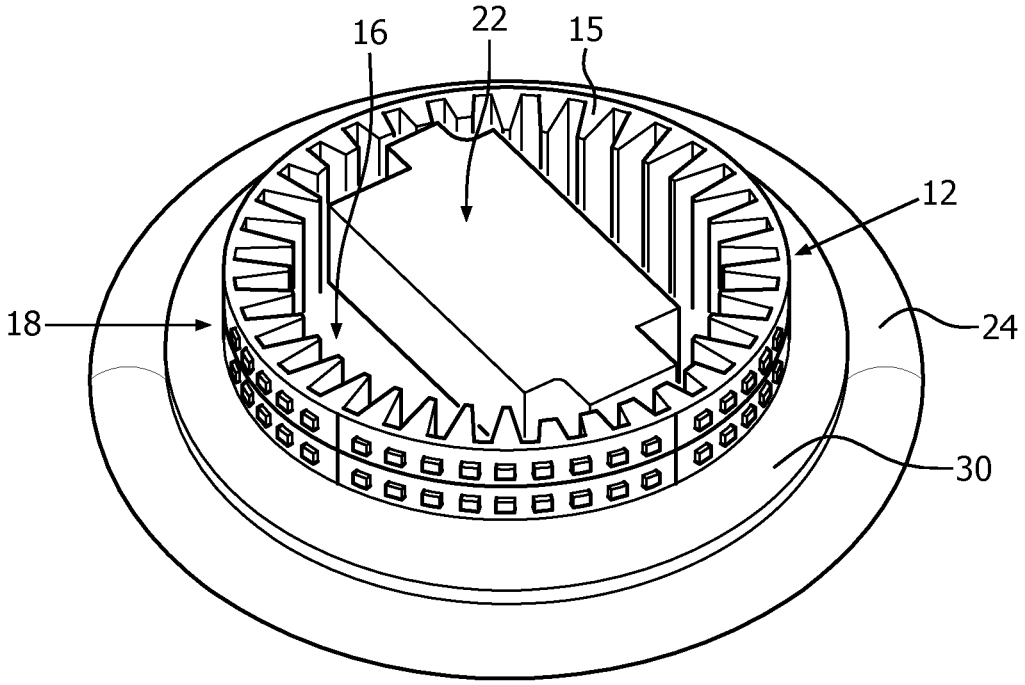
FIG. 5 shows more clearly how the driver is mounted.

As mentioned above, the lighting device may comprise a downlight for surface mounting on a surface or a downlight for recess mounting into a surface. However, the design may be used as other types of compact lighting unit, and is not limited to downlights. FIG. 5 shows more clearly how the driver 22 is mounted in the cavity 16. It shows the carrier 12, reflector ring 30, optical unit 24 and LED arrangement 18 in their relative orientations when assembled.

Figure 6:
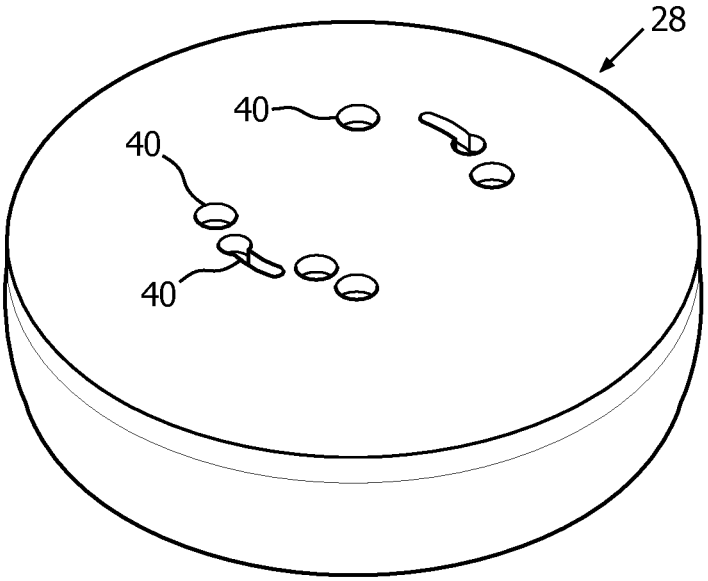
FIG. 6 shows the underside of the lighting device of FIG. 3.

FIG. 6 shows the underside of the lighting device of FIG. 3. The outer housing 28 has a flat top with mounting holes 40 for surface mounting or the same design may be recess mounted.

Figure 7:
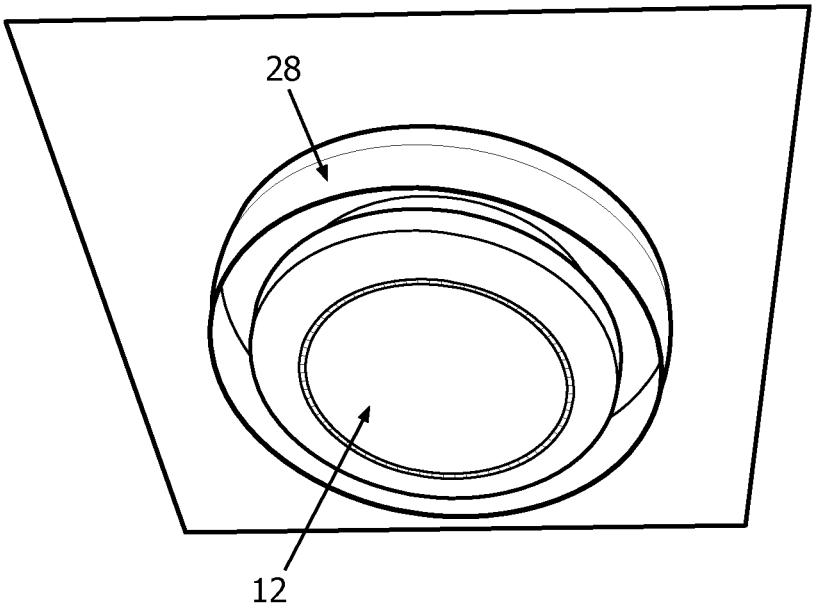
FIG. 7 shows the front side of the lighting device of FIG. 3.

FIG. 7 shows the front side of the lighting device of FIG. 3 but with the optical unit 24 omitted.

Figure 8:
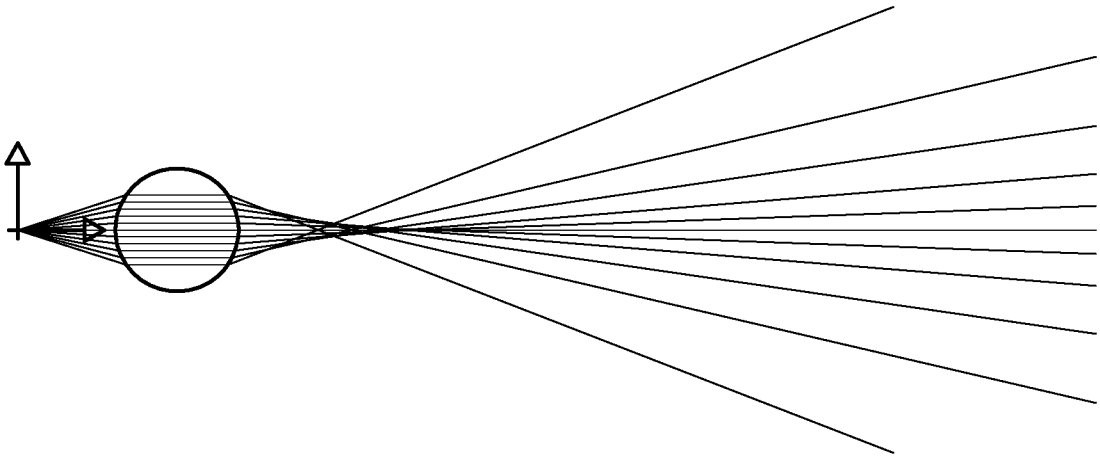
FIG. 8 is used to explain the optical function of the optical ring used in the lighting device of FIG. 3.

Optically, the spherical surface of a toric lens makes light converge to at a point as shown in FIG. 8. This gives an effect of an exploding light pattern from the point. The lighting device may be used indoors or outdoors. An outdoor luminaire is exposed to the outdoor environment, so it has to be sealed. One or more sealing rings may be integrated into the design to provide sealing for outdoor use. One seal may be provided between the carrier 12 and the optical unit 24 and another between the radially outermost part of the optical unit 24 and the housing 28.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device having an axis corresponding to a general direction in which the lighting device faces, comprising:

a carrier having a smooth, contiguous outer mounting surface extending around the axis and facing radially outwardly, and an inner cavity radially within the outer mounting surface; wherein the outer mounting surface has a cross sectional shape that is substantially a circle;

an arrangement of solid state lighting devices mounted on the outer mounting surface;

a driver mounted in the inner cavity;

a ring shaped optical unit which defines a light output region of the lighting device, mounted around the carrier; and an outer housing having a reflecting inner surface for reflecting light from the arrangement of solid state lighting devices to the ring shaped optical unit;

wherein the ring shaped unit has a cross sectional shape substantially according to a circle, so that the optical unit comprises a toric lens;

wherein the arrangement of solid state lighting devices comprises one or more arrays of LEDs mounted on one or more flexible carriers, each of said carriers being directly mounted to the outer mounting surface.

2. A lighting device as claimed in claim 1, wherein the ring shaped optical unit comprises a ring having a constant cross sectional shape in a plane perpendicular to the ring direction.

3. A lighting device as claimed in claim 2, wherein the ring is a circle.

4. A lighting device as claimed in claim 1, wherein the optical unit comprises an inner lip.

5. A lighting device as claimed in claim 1, wherein the carrier comprises heat dissipation fins which extend radially inwardly from the back of the outer mounting surface.

6. A lighting device as claimed in claim 1, further comprising a reflector ring mounted between the arrangement of solid state lighting devices and the optical unit.

7. A lighting device as claimed in claim 1, having a height less than 50 mm, for example less than 40 mm, for example less than 35 mm.

8. A lighting device as claimed in claim 1, comprising a downlight for surface mounting on a surface.

9. A lighting device as claimed in claim 1, comprising a downlight for recess mounting into a surface.

10. A lighting device as claimed in claim 1, wherein light passing through the optical unit is converted to a light output with a desired direction and beam shape.

11. A lighting device as claimed in claim 1, wherein the optical unit is made of a transparent material having a refractive index greater than 1.4 and less than 1.6.

12. A lighting device as claimed in claim 1, wherein the toric lens causes emitted light to converge at a point/circular line.

* * * * *